US006860036B2

(12) United States Patent
Zhu

(10) Patent No.: US 6,860,036 B2
(45) Date of Patent: Mar. 1, 2005

(54) WATERPROOF SHOE

(75) Inventor: George Zhu, Nantong (CN)

(73) Assignee: Nantong Atechs Invest Co., Ltd., Nantong (CN)

( * ) Notice: Subject to any disclaimer, the term of this patent is extended or adjusted under 35 U.S.C. 154(b) by 0 days.

(21) Appl. No.: 10/255,664

(22) Filed: Sep. 27, 2002

(65) Prior Publication Data

US 2003/0061737 A1 Apr. 3, 2003

(30) Foreign Application Priority Data

Sep. 29, 2001 (CN) ..... 01263035 U

(51) Int. Cl.[7] ..... A43B 23/07; A43B 13/22; A43B 23/16; A43B 23/00; A43B 23/08

(52) U.S. Cl. ..... 36/55; 36/98; 36/45; 36/57

(58) Field of Search ..... 36/55, 98, 14, 36/21, 22 A, 45, 48, 57

(56) References Cited

U.S. PATENT DOCUMENTS 2,634,441 A * 4/1953 Herlihy ..... 36/68
5,114,788 A * 5/1992 Nakagawa et al. ..... 428/284
RE34,890 E * 4/1995 Sacre ..... 36/55
5,499,459 A * 3/1996 Tomaro ..... 36/55
5,659,914 A * 8/1997 Steinlauf ..... 36/55
5,664,343 A * 9/1997 Byrne ..... 36/55
5,678,326 A * 10/1997 Pavelescu ..... 36/55
5,732,479 A * 3/1998 Pavelescu ..... 36/55
5,993,959 A * 11/1999 Nakabayashi et al. ..... 428/343
6,401,364 B1 * 6/2002 Burt ..... 36/45
6,446,360 B1 * 9/2002 Sheets et al. ..... 36/55

* cited by examiner

*Primary Examiner*—Anthony Stashick
(74) *Attorney, Agent, or Firm*—Crowell & Moring LLP

(57) ABSTRACT

A waterproof shoe includes a vamp, a sole and a foot wrapper that is inside the vamp and located on the upper part of the sole. The foot wrapper is assembled by stitching the upper lining with the bottom part. A waterproof band is provided over every seam line of the foot wrapper. The waterproof shoe can withstand water when soaked in 3–4 cm deep water for over eight hours. They are suitable for being worn in rains and snows.

31 Claims, 3 Drawing Sheets

WATERPROOF SHOE

TECHNICAL FIELD

This application claims the priority of Chinese Patent Document No. 01263035.7, filed Sep. 29, 2001, the disclosure of which is expressly incorporated by reference herein.

BACKGROUND AND SUMMARY OF THE INVENTION

The present invention relates to a waterproof shoe, in particular to a waterproof shoe that has a good waterproof property.

BACKGROUND TECHNOLOGY

Rubber shoes or boots are worn in rainy and snowy weather. Wearing rubber shoes or boots is cumbersome and inappropriate in formal occasions.

SUMMARY OF THE INVENTION

An object of the present invention is to provide a waterproof shoe that has a reliable waterproof structure, remains waterproof in 3–4 cm deep water for over eight hours, and is suitable for wearing in areas where rains and snows are frequent.

The above object of the invention is accomplished with a waterproof shoe of the present invention that comprises a vamp, a sole and a foot wrapper that is inside the vamp and is located on the upper part of the sole. The foot wrapper is assembled by joining or stitching the upper lining with the bottom part. A waterproof band is provided with every seam line of the foot wrapper. The foot wrapper includes a base cloth and a waterproof material disposed on the outside of the base cloth. The composition of the base cloth from the inside to the outside could be velvet and foamed cotton, and the waterproof material from the inside to the outside could be a waterproof film and a 50 D Mesh material. The waterproof band is hot stamped under a high temperature over every seam line of the foot wrapper with the assemblage seam line as the center axis. The waterproof band extends beyond the two ends of the seam line. The distance by which the waterproof band exceeds the two ends of the seam line is about 20–30 mm. There is an adhesive layer, such as a mucilage layer, between the waterproof band and every seam line of the foot wrapper for bonding the waterproof band with the foot wrapper at every seam line. The adhesive layer is about 20–40 mm wide, and the waterproof band on the adhesive layer is about 20–30 mm wide. The bottom part of the foot wrapper has the shape of a foot or the shape of a foot that is separated into two parts from the middle. It may also have the shape of a foot with an S-shaped or an inverse S-shaped seam line. There is a layer of waterproof adhesive coated on the base cloth of the vamp, and a waterproof thread is used to stitch up the vamp.

The structure of the waterproof shoe described above is both novel and practical. The waterproofing is reliable, and an isolating layer is formed by the waterproof wrapper. Because the surface of the waterproof wrapper is waterproofed, the water cannot go upwards along the outer surface of the waterproof wrapper. However, if the vamp material is not waterproof, the water may go upwards to the shoe opening along the surface of the shoe's outer surface to damp the velvet in the waterproof wrapper and further the inside of the shoe. Therefore, with the waterproof vamp, the vamp base cloth processed with waterproof adhesive, and the shoe lining with a waterproof wrapper, it is possible to prevent effectively the water from entering the shoe. The waterproof shoe of the present invention remains waterproof after being soaked in 3–4 cm deep water for over eight hours, so they are suitable to be worn in rains and snows to avoid the inconvenience that people must wear rubber boots in rainy and snowy weather.

Other objects, advantages and novel features of the present invention will become apparent from the following detailed description of the invention when considered in conjunction with the accompanying drawings.

BRIEF DESCRIPTION OF THE ACCOMPANYING DRAWINGS

DESCRIPTION OF THE EMBODIMENTS

Figure 1:
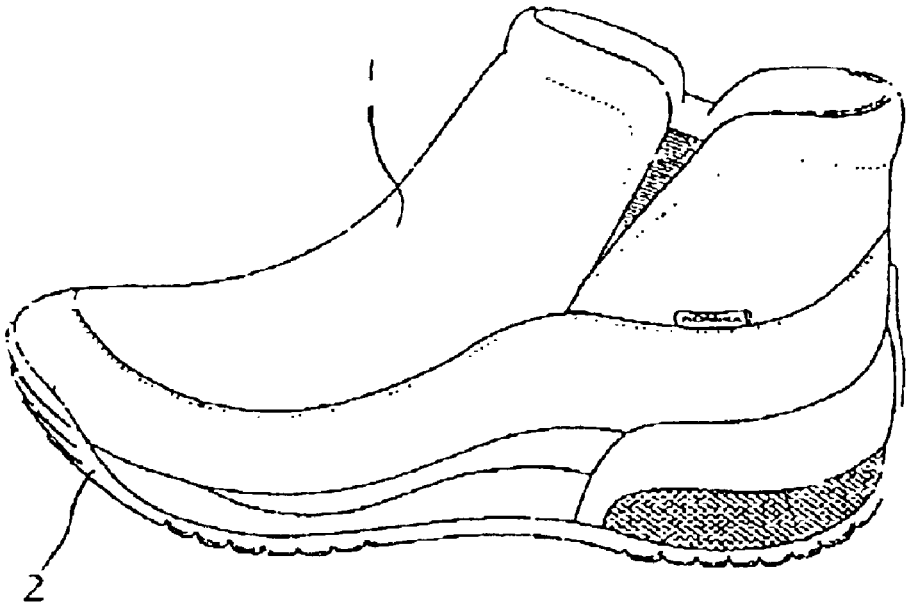
FIG. 1 is a schematic view of a waterproof shoe according to the present invention.

As shown in FIGS. 1–4, reference numeral 1 represents the vamp of the waterproof shoe, numeral 2 represents the sole of the waterproof shoe, numeral 3 represents the foot wrapper upper lining of the waterproof shoe, numeral 4 represents the bottom of the foot wrapper of the waterproof shoe, numeral 5 represents the seam line of the foot wrapper of the waterproof shoe, numeral 6 represents the waterproof adhesive layer coated at the seam lines of the foot wrapper of the waterproof shoe, and numeral 7 represents the waterproof band that is hot stamped over the seam line of the foot wrapper of the waterproof shoe.

Embodiment 1

Figure 2:
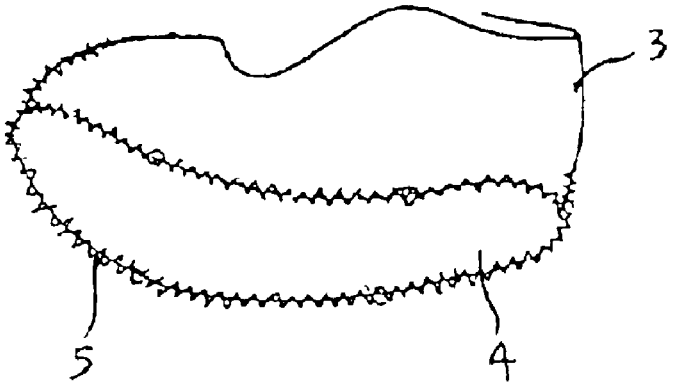
FIG. 2 is a schematic view of the waterproof foot wrapper of the waterproof shoe according to the present invention.
Figure 3:
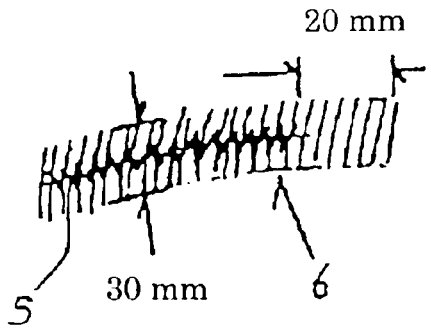
FIG. 3 is a schematic view of the waterproof adhesive on the waterproof foot wrapper in the waterproof shoe according to the present invention.
Figure 4:
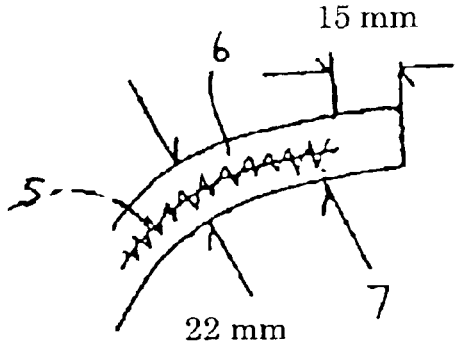
FIG. 4 is a schematic view of the waterproof band on the waterproof foot wrapper in the waterproof shoe according to the present invention.

In this embodiment of the present invention, as shown in FIGS. 1 and 2, the waterproof shoe includes a vamp 1, a sole 2, and a waterproof foot wrapper. The vamp 1 is bonded together with the sole 2 by waterproof adhesive, such as mucilage. The vamp 1 is made of a waterproof material. The base cloth of the vamp 1 is coated with a layer of waterproof adhesive. The waterproof foot wrapper is located inside the vamp 1 and on the upper part of the sole 2. The waterproof foot wrapper is assembled by stitching the upper lining 3 with the single piece bottom part 4 that has the shape of a foot. The foot wrapper is composed of a base cloth and a waterproof material. The base cloth can be velvet+foamed cotton. The waterproof material can be waterproof film+a suitable material, such as a toricot or 50D mesh material or, successively from the inside to the outside, velvet+foamed cotton+waterproof film+a suitable material, such as a toricot or 50 D mesh material. A waterproof band 7 (as shown in FIG. 4) is hot stamped over every seam line of the waterproof foot wrapper, and a layer of waterproof adhesive 6 is coated between the waterproof band and every seam line, the waterproof adhesive layer preferably being, for example, waterproof mucilage, with a width of 20–40 mm. During coating, both sides of the stitching seam should be equally coated. The adhesive layer preferably exceeds the two ends of the stitching seam by 20–30 mm each. The waterproof band 7 is hot stamped over the seams by a waterproof band stamping machine under high temperature after the adhesive layer 6 is dried, and the length of the waterproof band should exceed each end of the assemblage seam line by 15 mm. In addition, there can also be a waterproof processing layer on the upper lining 3. The waterproof vamp and the foot wrapper can form an integral whole by stitching together the vamp and the foot wrapper and turning it inside out. The relevant auxiliary materials of the entire waterproof shoe should also be waterproof, for example, the elastic cords, woven belts, side labels and etc.

The head of the waterproof foot wrapper is stitched and processed first, the heel next, and then the assembled upper lining 3 is stitched together with the single piece bottom part 4 that has the shape of a foot.

Embodiment 2

Figure 5:
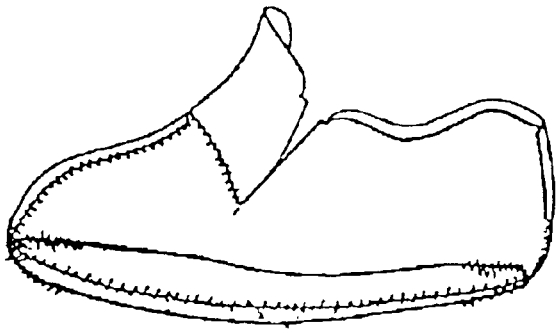
FIG. 5 is a schematic view of a second embodiment of the waterproof foot wrapper of the waterproof shoe according to the present invention.

In this embodiment, all the parts are the same as in the first embodiment, except the waterproof foot wrapper. As shown in FIG. 5, this embodiment has an alternative waterproof foot wrapper, the bottom part of which is formed of two parts that are joined along the certerline of the bottom. The stitching sequence of the foot wrapper is to stitch the heel first, then assemble the bottom part and the head part, finally assemble the tongue 8. This structure is firmer and has a better waterproof property.

Embodiment 3

Figure 6A:
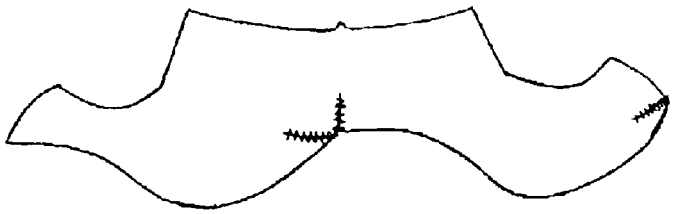
FIG. 6A is a schematic view of the structure of a third embodiment of waterproof foot wrapper of the waterproof shoe before it is stitched according to the present invention.
Figure 6B:
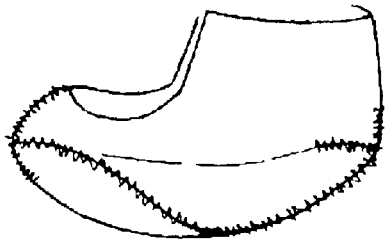
FIG. 6B is a schematic view of the first step of stitching the third embodiment of waterproof foot wrapper of the waterproof shoe according to the present invention.
Figure 6C:
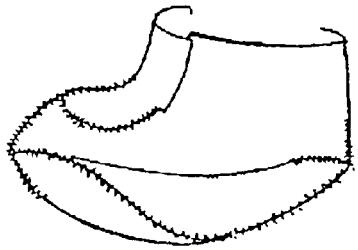
FIG. 6C is a schematic view of the second step of stitching the third embodiment of waterproof foot wrapper of the waterproof shoe according to the present invention.
Figure 7A:
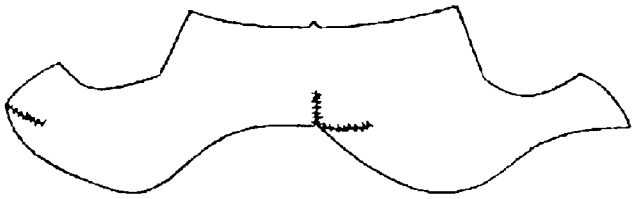
FIG. 7A is a schematic view of the structure of a fourth embodiment of waterproof foot wrapper of the waterproof shoe before it is stitched according to the present invention.
Figure 7B:
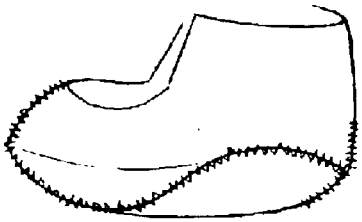
FIG. 7B is a schematic view of the first step of stitching the fourth embodiment of waterproof foot wrapper of the waterproof shoe according to the present invention.
Figure 7C:
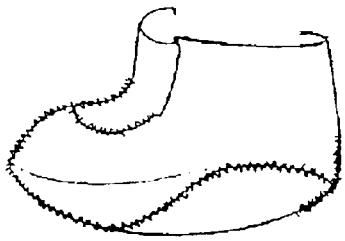
FIG. 7C is a schematic view of the second step of stitching the fourth embodiment of waterproof foot wrapper of the waterproof shoe according to the present invention.

In this embodiment, all the other parts are the same as in the first embodiment, except the waterproof foot wrapper. As shown in FIGS. 5, 6A, B, C, this embodiment has a waterproof foot wrapper, the bottom part of which has an S-shaped seam line. The stitching sequence of the entire foot wrapper is to stitch the heel and the head part first (FIG. 6A), then assemble the S-shaped bottom part, and finally assemble the tongue part.

Embodiment 4

In this Embodiment, except that the bottom part of the waterproof foot wrapper has an inverse S-shaped seam line, the other parts are the same as in the third embodiment.

What is claimed is:

1. A waterproof shoe comprising a vamp, a sole, a foot wrapper disposed in the vamp and on an upper cart of the sole, wherein the foot wrapper includes an upper lining, a bottom part, the upper lining and the bottom part of the foot wrapper being stitched together, and a waterproof band applied to each seam line of the foot wrapper, wherein the foot wrapper includes a base cloth and a waterproof material disposed on the outside of the base cloth, and wherein the base cloth of the foot wrapper includes velvet and foamed cotton disposed on the outside of the velvet, and the waterproof material of the foot wrapper includes a waterproof film and a toricot or 50 D mesh material disposed on the outside of the waterproof film.

2. The waterproof shoe as claimed in claim 1, wherein the waterproof band is hot stamped under high temperature over the seam line, and the waterproof band extends beyond the two ends of the seam line.

3. The waterproof shoe as claimed in claim 2, wherein the waterproof band extends beyond each end of the seam line by 20–30 mm.

4. The waterproof shoe as claimed in claim 3, further comprising an adhesive layer between the waterproof band and the seam line to bond the waterproof band to the seam line.

5. The waterproof shoe as claimed in claim 4, wherein the adhesive layer includes a mucilage layer.

6. The waterproof shoe as claimed in claim 4, wherein the adhesive layer is 20–40 mm wide, and the waterproof band is 20–30 mm wide.

7. The waterproof shoe as claimed in claim 6, wherein the bottom part of the foot wrapper has approximately the shape of a foot, the shape of a foot divided along the middle of the foot into two approximately equal parts, or the shape of a foot with an S shaped seam line or with an inverse S shaped seam line.

8. A waterproof shoe comprising a vamp, a sole, a foot wrapper disposed in the vamp and on an upper part of the sole, wherein the foot wrapper includes an upper lining, a bottom part, the upper lining and the bottom part of the foot wrapper being stitched together, and a waterproof band applied to each seam line of the foot wrapper, and wherein the vamp includes a waterproof material.

9. The waterproof shoe as claimed in claim 8, wherein the vamp is stitched with a waterproof thread.

10. The waterproof shoe as claimed in claim 9, wherein the vamp includes a base cloth and a layer of waterproof mucilage coated on the base cloth.

11. The waterproof shoe as claimed in claim 7, wherein the vamp includes a waterproof material, is stitched with a waterproof thread, and includes a base cloth and a layer of waterproof mucilage coated on the base cloth.

12. A method of making a waterproof shoe comprising disposing a foot wrapper of the shoe in a vamp of the shoe and on an upper part of a sole of the shoe, stitching together an upper lining of the foot wrapper and a bottom part of the foot wrapper, applying a waterproof band to each seam line of the foot wrapper, making the foot wrapper from a base cloth and a waterproof material disposed on the outside of the base cloth, making the base cloth of the foot wrapper from velvet and foamed cotton disposed on the outside of the velvet, and making the waterproof material of the foot wrapper a waterproof film and a toricot or 50 D mesh material disposed on the outside of the waterproof film.

13. The method as claimed in claim 12, further comprising hot stamping the waterproof band under high temperature over the seam line, and making the waterproof band extend beyond the two ends of the seam line.

14. The method as claimed in claim 13, further comprising placing an adhesive layer between the waterproof band and the seam line to bond the waterproof band to the seam line.

15. The method as claimed in claim 14, further comprising forming the bottom part of the foot wrapper from two approximately equal parts divided in the middle of the bottom part.

16. The method as claimed in claim 14, further comprising forming the bottom part of the foot wrapper with an S shaped seam line or with an inverse S shaped seam line.

17. A waterproof shoe comprising a vamp, a sole, a foot wrapper disposed in the vamp and on an upper part of the sole, wherein the vamp includes a waterproof material and is stitched with a waterproof thread, the foot wrapper includes an upper lining, a bottom part, the upper lining and the bottom part of the foot wrapper being stitched together, and a waterproof band having wide of 20–30 mm and applied to each seam line of the foot wrapper, the upper lining includes a base cloth including velvet and foamed cotton disposed on the outside of the velvet and a waterproof material disposed on the outside of the base cloth.

18. The waterproof shoe as claimed in claim 17, wherein the waterproof material of the foot wrapper includes a waterproof film and a toricot or 50 D mesh material disposed on the outside of the waterproof film.

19. The waterproof shoe as claimed in claim 18, wherein the waterproof band is hot stamped under high temperature over the seam line, and the waterproof band extends beyond the two ends of the seam line.

20. The waterproof shoe as claimed in claim 19, wherein the waterproof band extends beyond each end of the seam line by 20–30 mm.

21. The waterproof shoe as claimed in claim 20, further comprising an adhesive layer between the waterproof band and the seam line to bond the waterproof band to the seam line.

22. The waterproof shoe as claimed in claim 21, wherein the adhesive layer includes a mucilage layer.

23. The waterproof shoe as claimed in claim 21, wherein the adhesive layer is 20–40 mm wide.

24. The waterproof shoe as claimed in claim 23, wherein the bottom part of the foot wrapper has approximately the shape of a foot, the shape of a foot divided along the middle of the foot into two approximately equal parts, or the shape of a foot with an S shaped seam line or with an inverse S shaped seam line.

25. The waterproof shoe as claimed in claim 17, wherein the vamp includes a base cloth and a layer of waterproof mucilage coated on the base cloth.

26. The waterproof shoe as claimed in claim 24, wherein the vamp includes a waterproof material, is stitched with a waterproof thread, and includes a base cloth and a layer of waterproof mucilage coated on the base cloth.

27. A method of making a waterproof shoe comprising making the base cloth from velvet and foamed cotton disposed on the outside of the velvet, making the waterproof material from a waterproof film and a toricot or 50 D mesh material disposed on the outside of the waterproof film, making the foot wrapper from a base cloth and a waterproof material disposed on the outside of the base cloth, disposing a foot wrapper of the shoe in a vamp of the shoe and on an upper part of a sole of the shoe, stitching together an upper lining of the foot wrapper and a bottom part of the foot wrapper, applying a waterproof band to each seam line of the foot wrapper, and hot stamping the waterproof band under high temperature over the seam line.

28. The method as claimed in claim 27, further comprising making the waterproof band extend beyond the two ends of the seam line.

29. The method as claimed in claim 28, further comprising placing an adhesive layer between the waterproof band and the seam line to bond the waterproof band to the seam line.

30. The method as claimed in claim 29, further comprising forming the bottom part of the foot wrapper from two approximately equal parts divided in the middle of the bottom part.

31. The method as claimed in claim 29, further comprising forming the bottom part of the foot wrapper with an S shaped seam line or with an inverse S shaped seam line.

* * * * *